US006231212B1

(12) United States Patent
Cooney et al.

(10) Patent No.: US 6,231,212 B1
(45) Date of Patent: May 15, 2001

(54) FLUORESCENT LAMP BAFFLE

(75) Inventors: Anita Cooney; Anthony Caradona; Evan Douglis, all of New York, NY (US)

(73) Assignee: Aced Designs, Inc., New York, NY (US)

( * ) Notice: Subject to any disclaimer, the term of this patent is extended or adjusted under 35 U.S.C. 154(b) by 0 days.

(21) Appl. No.: 09/473,882

(22) Filed: Dec. 28, 1999

(51) Int. Cl.[7] ..... F21V 21/29

(52) U.S. Cl. ..... 362/290; 362/291; 362/292; 362/256; 362/354

(58) Field of Search ..... 362/290, 255, 362/256, 291, 292, 296, 217, 354

(56) References Cited

U.S. PATENT DOCUMENTS 3,148,835 * 9/1964 Horelick ..... 362/255
4,559,584 * 12/1985 Kuwahata et al. ..... 362/86
4,613,929 * 9/1986 Totten ..... 362/150
5,711,594 * 1/1998 Hay ..... 362/84
6,149,285 * 11/2000 Cicarelli ..... 362/255

* cited by examiner

*Primary Examiner*—Alan Cariaso
*Assistant Examiner*—Ronald E. DelGizzi
(74) *Attorney, Agent, or Firm*—Hopgood, Calimafde, Judlowe & Mondolino

(57) ABSTRACT

A baffle mountable on the tube of a fluorescent lamp which in the absence of the baffle yields a harsh and glaring light. The baffle is formed of a long strip of fabric material having a row of holes therein through which the tube is threaded to cause the strip to assume the shape of an undulating shade which conceals the lamp. The felt strip is preferably constituted by a pressed, non-woven felt fabric whose fibers are reflective of light and absorbent of sound or a similar flexible absorptive material. Light rays emitted by the lamp are intercepted and dispersed by the shade, thereby diffusing the light and softening the illumination. Ambient sounds impinging on the undulating shade are absorbed thereby to reduce the noise in the room in which the lamp is installed.

11 Claims, 4 Drawing Sheets

FLUORESCENT LAMP BAFFLE

BACKGROUND OF INVENTION

1. Field of Invention

This invention relates generally to a baffle that fits onto the tube of a fluorescent lamp to assume the shape of an undulating shade that acts to diffuse the light emanating from the lamp and soften the illumination provided thereby as well as to absorb ambient sounds to reduce the noise in the room in which the lamp fixture is installed.

2. Status of Prior Art

A fluorescent lamp operates by converting ultraviolet energy into visible light. A fluorescent lamp is provided with a glass tube whose inner surface has a phosphor coating adapted to absorb radiant energy of a given wavelength and to reradiate it at a longer wavelength.

Contained in the glass tube are electrodes and a small amount of mercury. The electrodes provide a source of electrons to initiate an arc discharge which vaporizes the mercury to produce ultraviolet energy that excites the phosphors. A fluorescent lamp produces visible light at several times the efficiency of an incandescent bulb having a filament heated by current passing therethrough. Hence a 30 watt fluorescent lamp yields substantially more light than a 100 watt incandescent bulb.

However light generated by a fluorescent lamp lies mainly in the short wavelength portion of the visible light spectrum, whereas light emitted from an incandescent bulb lies mainly in the long wavelength portion. As a consequence of this distinction, though light from a fluorescent lamp is brighter than light from an incandescent bulb having the same wattage, the light emitted by the lamp is harsh and glaring, and therefore difficult on the eyes of those who are exposed to its rays.

Because of the drawback of fluorescent lamps, their use is largely confined to industrial and commercial applications that require high levels of illumination. Another reason why fluorescent lamps are not found in domestic and non-commercial environments except in kitchens, is that their appearance is strictly utilitarian and not usually acceptable for such environments.

Yet another factor militating against the use of fluorescent lamp fixtures is that ambient sounds impinging thereon are bounced, not absorbed thereby. This makes it difficult to fully acoustically insulate the room in which the fixtures are installed. Thus should the room ceiling in the regions thereof surrounding the fixtures be lined with acoustic tiles to absorb ambient sounds, the sounds will be enhanced by the sounds reflected from the fixtures. Hence the noise level in the room will remains high, particularly if several fluorescent light fixtures are installed therein.

Since the present invention deals with a baffle that fits onto the tube of a fluorescent lamp and acts as a light shade, of prior art interest are the following patents:

The patent to Curzon U.S. Pat. No. 2,595,771 (1952) shows a fluorescent tube on which is fitted a solid glass or plastic shade that runs the length of the tube. The 1961 Frantz U.S. Pat. No. 2,990,763 discloses a mercury vapor lamp for use in photographic printing onto which is fitted a row of horseshoe-shaped plates which act to collimate the light rays from the lamp. The 1964 patent to Long U.S. Pat. No. 3,140,055 fits an elongated U-shaped plastic shield onto a fluorescent lamp.

The patent to Peterson U.S. Pat. No. 4,122,511 (1978) is of interest because it considers the effect of attaching a shade onto a fluorescent lamp to reduce glare. Peterson who clamps a plastic shade onto the fluorescent tube, points out that prior art shades, though reducing glare, also sharply reduce the amount of light emanating from the lamp. The main advantage of the Peterson shade is that even though it reduces glare, it ensures utilization of at least 75% of the light emitted from the tubular lamp.

In the Lautzenheiser U.S. Pat. No. 5,490,467 (1995) a tubular lens is telescopically mounted over a fluorescent lamp to reduce glare. This lens is formed by prism-shaped triangular rings. In the 1993 Sugimoto U.S. Pat. No. 5,241,462, supported on a fluorescent tube on either side thereof is a wing composed of parallel, transparent prisms which act to disperse the light. In the to Suzuki U.S. Pat. No. 5,101,330 and Katoh U.S. Pat. No. 5,144,539, a fluorescent lamp is mounted on a reflecting plate whose reflected rays are projected through a diffusion plate.

SUMMARY OF INVENTION

In view of the foregoing, the main object of this invention is to provide a baffle acting to conceal a fluorescent light fixture and to diffuse and soften light emanating therefrom as well as to absorb ambient sounds.

More particularly, an object of this invention is to provide a baffle of the above type formed of a flat strip of pressed felt material which when mounted on the tube of the fluorescent lamp, then creates a shade having an undulating three-dimensional pattern.

Also an object of the invention is to provide a flat strip of felt or similar material for forming an undulating baffle, the edges of the strip being scalloped or otherwise contoured to cause the baffle to assume a sculptured form.

Among the significant advantages of a baffle in accordance with the invention are the following:

A. The baffle masks the utilitarian aspects of the fluorescent light fixture and imparts an attractive appearance thereto, thereby rendering the fixture acceptable in domestic and other environments in which fluorescent lamp fixtures are interdicted.

B. The strip of felt material from which the baffle is created can be so contoured that when the baffle is mounted on the tube of a fluorescent lamp fixture, the internally illuminated baffle then appears to be an abstract sculptural form. Hence what a viewer sees is not a light fixture but an illuminated work of art.

C. The felt baffle in an undulating pattern has an exposed surface whose area is much greater than the area of the ceiling occupied by the fluorescent light fixture; hence the degree to which the baffle absorbs ambient sounds and reduces the noise level in the room is greatly enhanced.

D. The baffle fabricated of soft felt material is inexpensive to manufacture and can be mounted without difficulty onto the tube of a fluorescent lamp.

Briefly stated, these objects are attained by a baffle mountable on the tube of a fluorescent lamp which in the absence of the baffle yields a harsh and glaring light. The baffle is formed of a long strip of felt material having a row of holes therein through which the tube is threaded to cause the strip to assume the shape of an undulating shade which conceals the lamp.

The felt strip is constituted by a pressed non-woven fabric whose fibers are reflective of light and absorbent of sound. Light rays emitted by the lamp are intercepted and dispersed by the shade, thereby diffusing the light and softening the illumination. Ambient sounds impinging on the undulating shade are absorbed thereby to reduce the noise in the room in which the lamp is installed.

BRIEF DESCRIPTION OF DRAWING

For a better understanding of the invention, as well as further features thereof, reference is made to the detailed description thereof to be read in connection with the annexed drawings wherein.

DESCRIPTION OF INVENTION

First Embodiment

Figure 1:
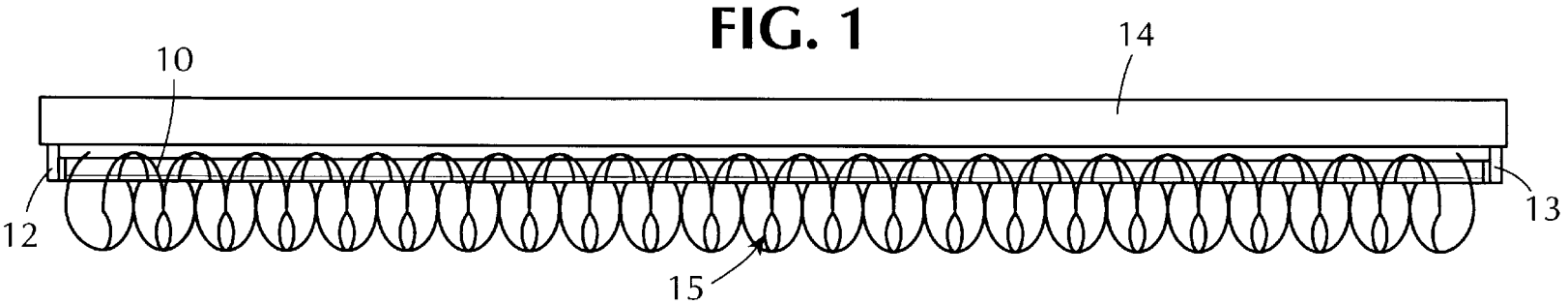
FIG. 1 is a side elevation of a lamp fixture having a pair of lamps on whose tubes is mounted a baffle in accordance with a first embodiment of the invention.
Figure 2:
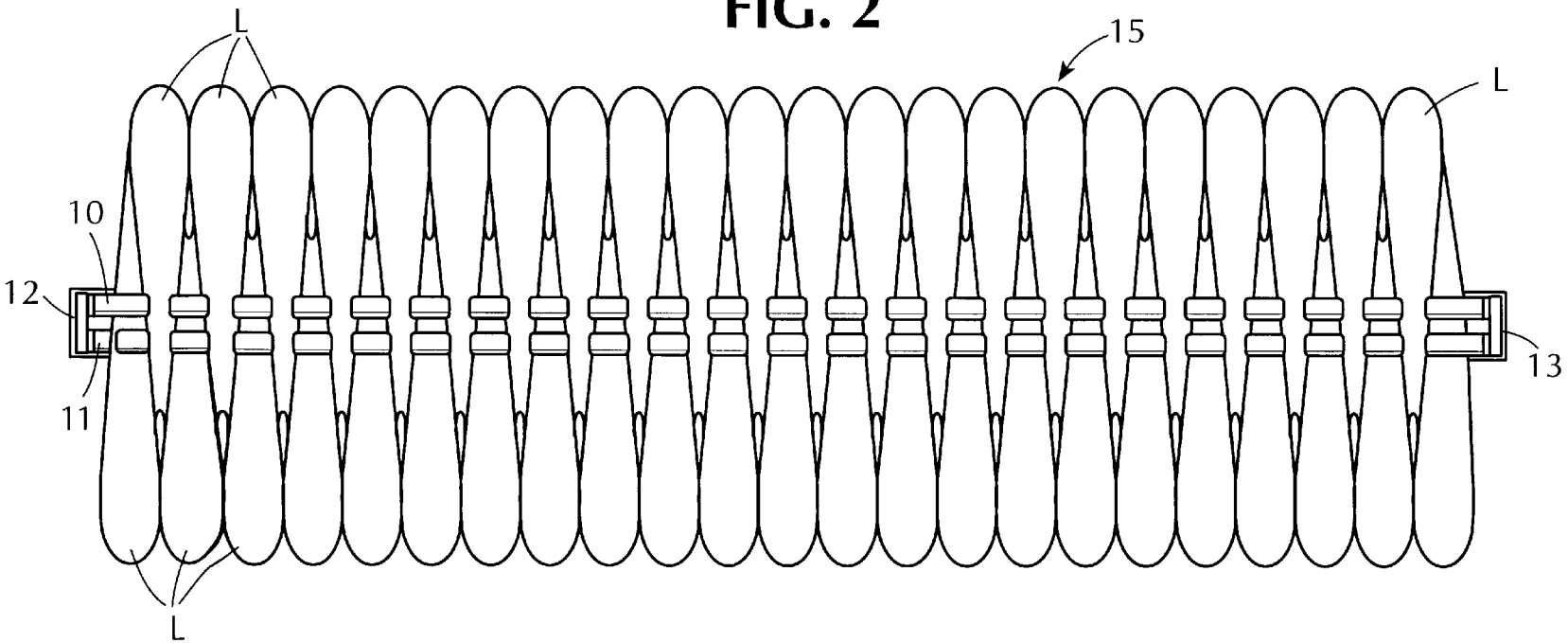
FIG. 2 is a plan view of the baffle shown in FIG. 1.

Referring now to FIGS. 1 and 2, shown therein is a standard fluorescent light fixture provided with a pair of fluorescent lamps 10 and 11 in parallel relation. The opposing ends of each lamp are received in sockets 12 and 13 projecting from an elongated rectangular box 14. This box houses the ballast and other electrical components included in a standard fluorescent light fixture.

Mounted on the tubes of the parallel fluorescent lamps 10 and 11 is a baffle, generally identified by reference numeral 15. As separately shown in FIG. 3, baffle 15 is fabricated from a long strip of soft, pressed felt material. This strip is die cut and punched to produce a row of hole clusters C, the opposing edges $E_1$ and $E_2$ of the strip being scalloped. The length of the strip is much greater than that of the tube on which it is to be mounted.

Each cluster C of holes is formed by four holes $H_1$, $H_2$, $H_3$ and $H_4$ at the corners of an imaginary square. The scalloped edges $E_1$ and $E_2$ of the strip each define a series of equispaced lobes L and a series of troughs T, each trough T, lying between successive lobes L. All of the holes have a like diameter which is substantially the same as the diameter of the tubes of the fluorescent lamps on which the baffle is mounted.

The arrangement is such that each cluster C of holes is symmetrically disposed with respect to a trough T on the scalloped upper edge $E_1$ of the strip and with respect to a lobe L on the lower edge $E_2$.

In order to mount the baffle on the tubes of the fluorescent lamps 10 and 11, the lamp must first be taken out of their sockets 12 and 13.

Figure 4:
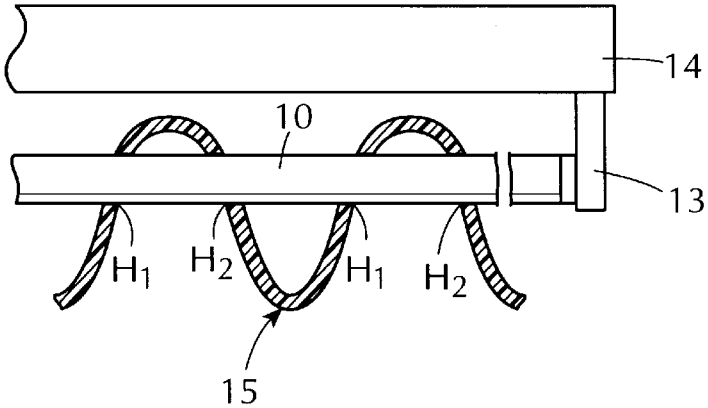
FIG. 4 is a side view of one of the fluorescent lamp tubes, the tube being threaded through holes in the strip of felt shown in FIG. 3.
Figure 3:
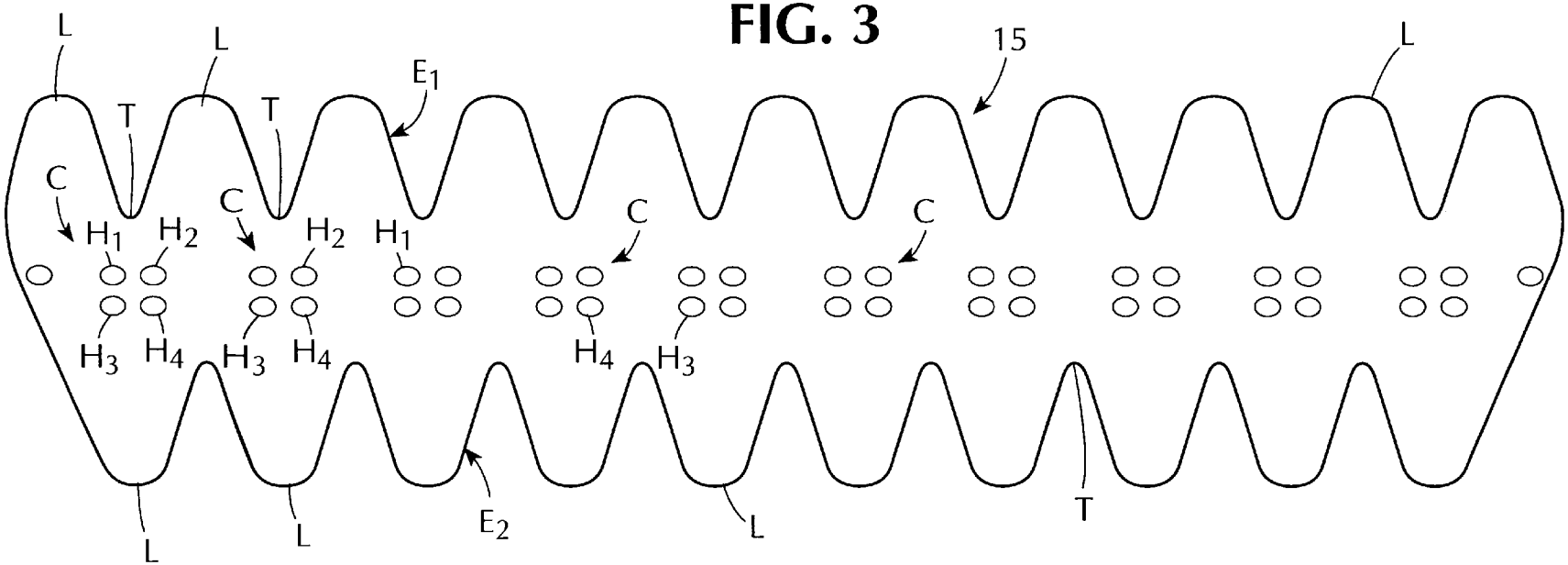
FIG. 3 illustrates the flat strip of felt material which is die cut and punched to create a baffle of the type shown in FIG. 1.
Figure 5:
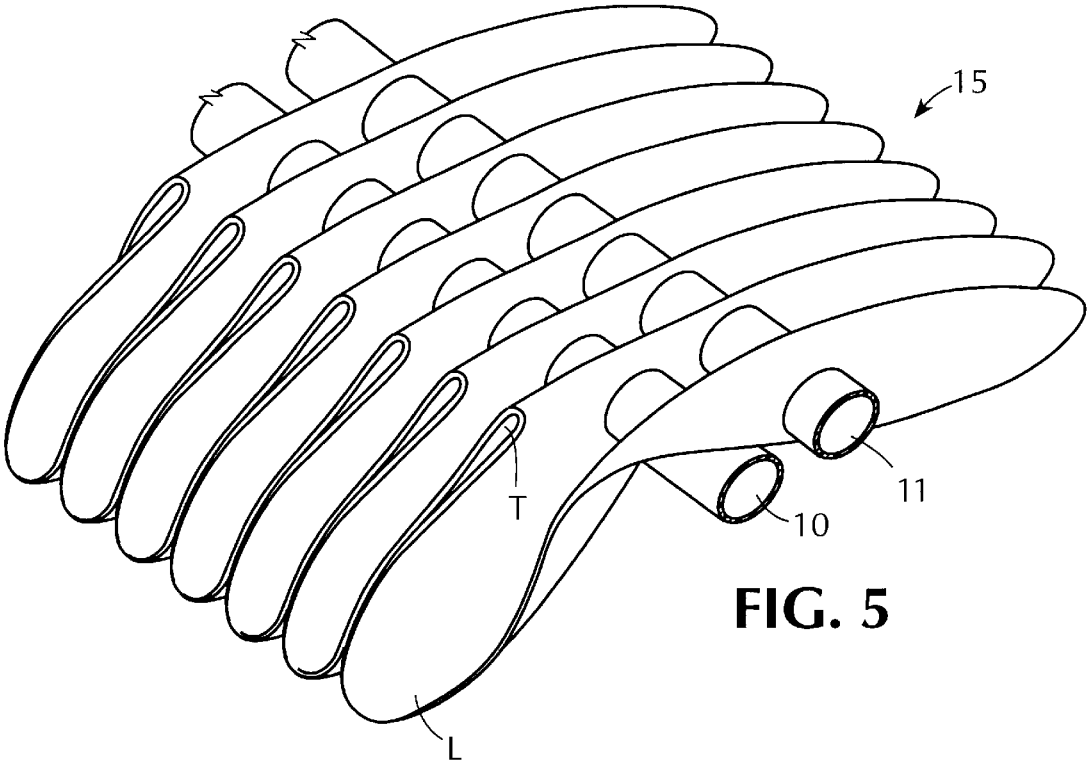
FIG. 5 is a perspective view of the baffle shown in FIG. 1.

The tube of lamp 10 is then threaded through the upper holes $H_1$ and $H_2$ in the series of hole clusters C in the felt strip shown in FIG. 3. As a consequence of this action, as shown in FIG. 4, the felt strip then assumes the form of a shade or baffle 15 having an undulating pattern. The tube of lamp 11 is similarly threaded through the lower holes $H_3$ and $H_4$ of the series of clusters C.

When, as shown in FIG. 1 and 2 the tubes of the fluorescent lamps on which is mounted undulating baffle 15, are fitted onto sockets 12 and 13 of the light fixture; then the lobes L at opposing edges of the strip form outstretched wings which extend from opposing sides of the fixture. The fixture is then effectively concealed by the baffle and a viewer looking upwardly at the ceiling on which the fixture is installed sees only the undulating felt baffle.

The Baffle Material

Traditional fabrics are made by spinning, knitting or weaving together natural or synthetic plastic fibers. A baffle in accordance with the invention is formed from a strip of soft, pressed felt material whose optical and acoustic properties are appropriate to the use to which the felt is put.

Pressed felt is defined as a non-woven fabric containing natural and/or man-made, synthetic fibers treated by a suitable combination of mechanical actions, pressure, heat and moisture without spinning, weaving or knitting.

A preferred felt material for forming a baffle in accordance with the invention is a soft felt fabricated from non-flammable synthetic plastic fibers, such as polyethylene, PVC, nylon or polyacetate, or by fibers which have been treated to render the felt fire-proof. The fibers forming the felt material has a matte white color so that the fibers are light reflective but do not glitter.

The invention is not limited to felt material, for the baffle may be formed of flexible material having similar properties, such as multi-layer textural fabrics formed of synthetic propylene fibers.

It is to be noted that a fluorescent lamp, even of high wattage produces relatively little heat; hence even if the felt baffle were formed of flammable natural fibers, the fibers would not be caused to burn.

Because the felt material is formed by non-woven fibers, the pressed felt is porous and somewhat light permeable. In the absence of the felt baffle, light rays emanating from the fluorescent lamp produce a harsh light and glaring illumination. But when the undulating felt baffle is mounted on the tube of the fluorescent lamp fixture, the light rays therefrom are intercepted by the randomly-oriented white fibers and the rays are dispersed over the undulating surface of the baffle and diffused thereby to soften the illumination without however substantially reducing its intensity.

Felt has sound absorbing properties, for sound waves impinging on the randomly-oriented fibers penetrate the interstices of the fibers and are buried therein, rather than being reflected by the fibers. In an undulating felt shade in accordance with the invention, the overall surface area of the shape is far greater than the area of the ceiling or other surfaces occupied by the fluorescent light fixtures. Hence the undulating felt shade or baffle functions as a sound sink that absorbs far more ambient sound than would be absorbed had the ceiling area to be occupied by the fixture been covered with a flat felt mat.

When several felt-baffled fluorescent light fixtures are installed on the ceiling of a restaurant or other large room which when crowded can become very noisy, the ceiling baffles which soften the illumination also function as sound traps to markedly reduce the noise level in the room.

The elongated glass tube of a fluorescent lamp is somewhat fragile and must be carefully handled. Since it is necessary when mounting a felt baffle on this tube to thread the tube through a row of holes in the felt strip forming the baffle, it is desirable to protect the glass tube.

Figure 8:
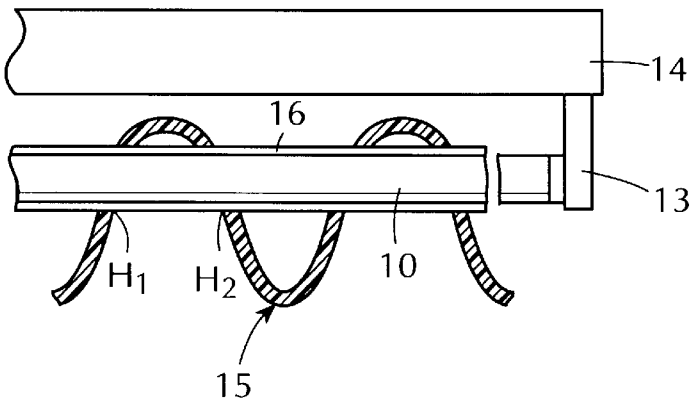
FIG. 8 illustrates a protective sleeve which envelopes the tube of a fluorescent lamp on which a baffle in accordance with the invention is mounted.

To this end, as shown in FIG. 8, before the felt strip 15 forming the baffle is mounted on the tube of the fluorescent lamp 10, the tube is telescoped into a protective sleeve 16 of transparent synthetic plastic film material, such as PVC or acrylic, making it possible to more or less roughly handle the protected tube when mounting the baffle therein. But even if the tube were to break when being roughly handled, its glass fragments would be safely confined within the protective sleeve.

Second Embodiment

In a baffle in accordance with the invention, the ultimate appearance of the baffle and its aesthetic appeal depends on the edge contouring as well as the width of the felt strip from which the baffle is formations.

But regardless of the nature of the contouring, the felt strip must have a row of holes into which the tube of the fluorescent lamp is threaded in order to cause the strip to assume an undulating pattern. However, by means of a wider strip and contour changes one can alter the geometry of the undulating baffle to create baffles having unusual sculptured forms.

Figure 6:
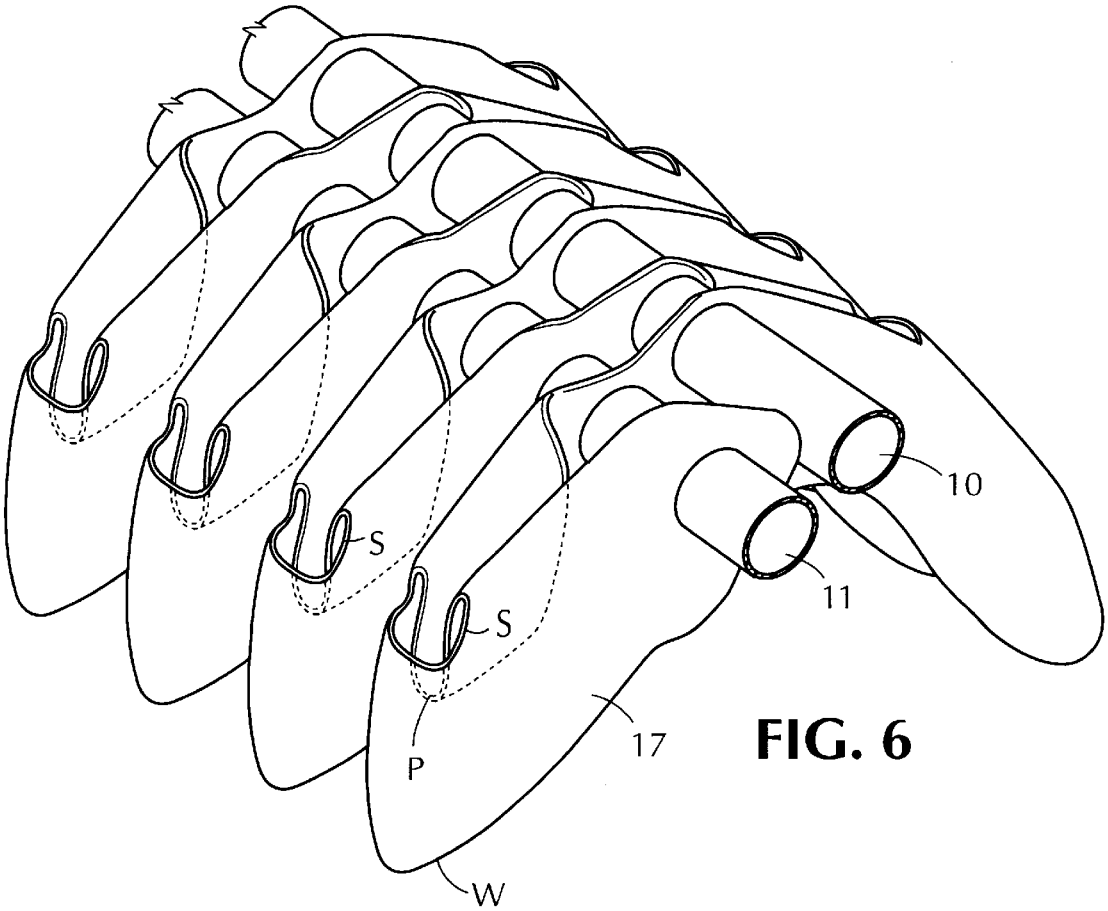
FIG. 6 is a perspective view of a second embodiment of a baffle in accordance with the invention, as seen from its outer side.
Figure 7:
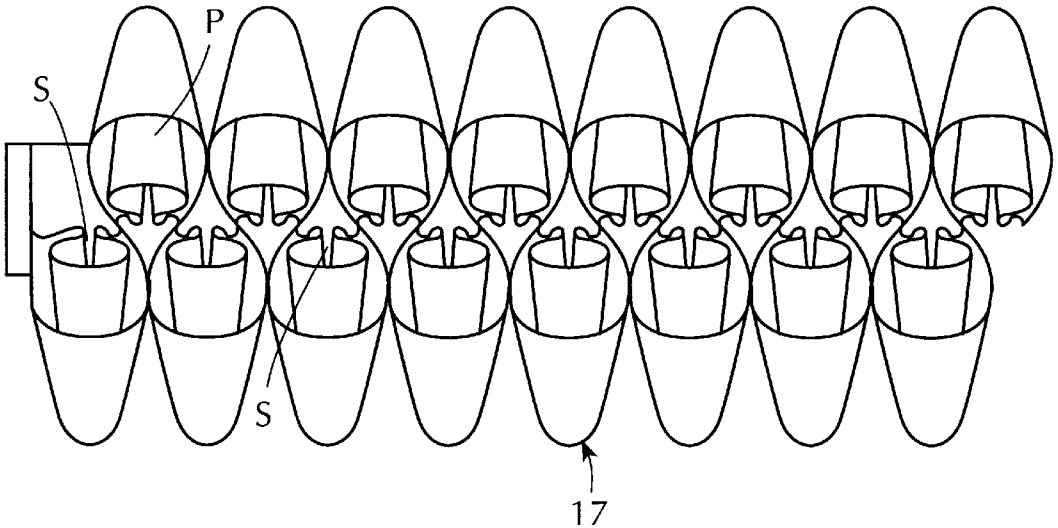
FIG. 7 is a bottom view of the baffle shown in FIG. 6.

In the baffle shown in FIGS. 6 and 7, the felt strip which forms baffle 17 mounted on fluorescent lamp tubes 10 and 11, in addition to scalloped undulating edges which create the wings of the baffle, there is a row of generally rectangular slots S parallel to the row of holes for receiving the tubes. When the wings of the baffle are outstretched, it is then possible to push into each slot S a mid-section the wing to create a pocket P. Each wing then assumes the form of a hood which, as shown in FIG. 7, accommodates the pocket.

This baffle arrangement not only produces a complex, abstract sculptural form that is attractive, but it also enlarges the exposed surface area of the baffle to enhance its sound-absorbing properties.

While there has been shown and described preferred embodiments of a fluorescent lamp baffle, it will be appreciated that many changes and modifications may be made therein without, however, departing from the essential spirit thereof. Thus while the baffle has been illustrated in association with a pair of fluorescent lamps it may be adapted to fit onto a single tube or to a triple-lamp fixture.

We claim:

1. A baffle mountable on the tube of a fluorescent lamp which in the absence of the baffle emits a harsh and glaring light, said baffle comprising a strip of soft flexible fabric material having a length greater than that of the tube and a row of holes through which the tube is threaded to cause the strip to assume an undulating pattern which effectively conceals the lamp; the strip being formed of fibers which act to intercept and disperse the light from the lamp impinging thereon, thereby diffusing and softening the illumination.

2. A baffle as set forth in claim 1, in which the strip is relatively broad and has opposing edges that are scalloped to define a series of lobes whereby when the strip assumes an undulating pattern, then create outstretched wings extending from the tube.

3. A baffle as set forth in claim 1, in which the strip is formed of felt material.

4. A baffle as set forth in claim 3, in which the fibers of the felt material are synthetic plastic fibers which are non-flammable.

5. A baffle as set forth in claim 3, in which the fibers of the felt material are a mixture of natural and synthetic fibers.

6. A baffle as set forth in claim 3, in which the fibers are made of polypropylene.

7. A baffle as set forth in claim 1, in which the fibers are randomly-oriented and are white in color so as to be reflective of the light rays impinging thereon.

8. A baffle as set forth in claim 1, for shading a pair of lamps having parallel tubes, said strip having parallel rows of holes to receive these tubes.

9. A baffle as set forth in claim 1, in which said felt material is absorbent of ambient sounds whereby when the baffle is mounted on a fixture in a noisy room, the baffle acts to reduce the noise level.

10. A baffle as set forth in claim 1, in which the tube on which the baffle is mounted is inserted within a protective sleeve of transparent plastic film material.

11. A baffle as set forth in claim 10, in which the sleeve is formed of PVC.

* * * * *

UNITED STATES PATENT AND TRADEMARK OFFICE

CERTIFICATE OF CORRECTION

PATENT NO. : 6,231,212 B1
DATED : May 15, 2001
INVENTOR(S) : Anita Cooney, Anthony Caradonna, & Evan Douglis It is certified that error appears in the above-identified patent and that said Letters Patent is hereby corrected as shown below:

Title page,
Item [75], Inventor Anthony Caradonna's name is mispelled. Please replace it with -- Caradonna --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*